US006705740B1

(12) United States Patent
Weinreich

(10) Patent No.: US 6,705,740 B1
(45) Date of Patent: Mar. 16, 2004

(54) TRACKING MIRROR

(76) Inventor: Steve Weinreich, 14 Norton Rd., Monmouth Jct., NJ (US) 08852

( * ) Notice: Subject to any disclaimer, the term of this patent is extended or adjusted under 35 U.S.C. 154(b) by 45 days.

(21) Appl. No.: 09/624,483

(22) Filed: Jul. 24, 2000

Related U.S. Application Data

(60) Provisional application No. 60/146,040, filed on Jul. 28, 1999.

(51) Int. Cl.[7] ..... F21V 33/00

(52) U.S. Cl. ..... 362/135; 362/350; 362/806; 472/63; 359/860

(58) Field of Search ..... 362/135, 347, 362/350, 359, 363, 806, 809, 811; 472/63; 40/900; 359/839, 838, 860

(56) References Cited

U.S. PATENT DOCUMENTS 3,634,679 A * 1/1972 Krzyston ..... 362/811
3,651,319 A * 3/1972 Norris et al. ..... 362/811
3,679,888 A * 7/1972 Reiback ..... 362/811
3,772,511 A * 11/1973 Marban ..... 362/806
4,164,823 A * 8/1979 Marsico ..... 362/811
4,307,528 A * 12/1981 Dewees et al. ..... 362/811
4,832,453 A * 5/1989 Saad-Cook ..... 362/811
5,050,056 A * 9/1991 Ellison ..... 362/811
5,214,539 A * 5/1993 Sorko-Ram ..... 359/839
5,311,335 A * 5/1994 Crabtree ..... 362/811
5,346,433 A * 9/1994 Weinreich ..... 472/63
5,365,378 A * 11/1994 Sorko-Ram ..... 359/839

* cited by examiner

*Primary Examiner*—Sandra O'Shea
*Assistant Examiner*—Peggy A Neils

(57) ABSTRACT

An apparatus that appears to actively track the position of a viewer by producing a red circle about the viewer's image, seen in a security mirror. The red circle appears to translate and rotate to track the viewer's position. Rotational tracking operates independently of the mirror.

19 Claims, 7 Drawing Sheets

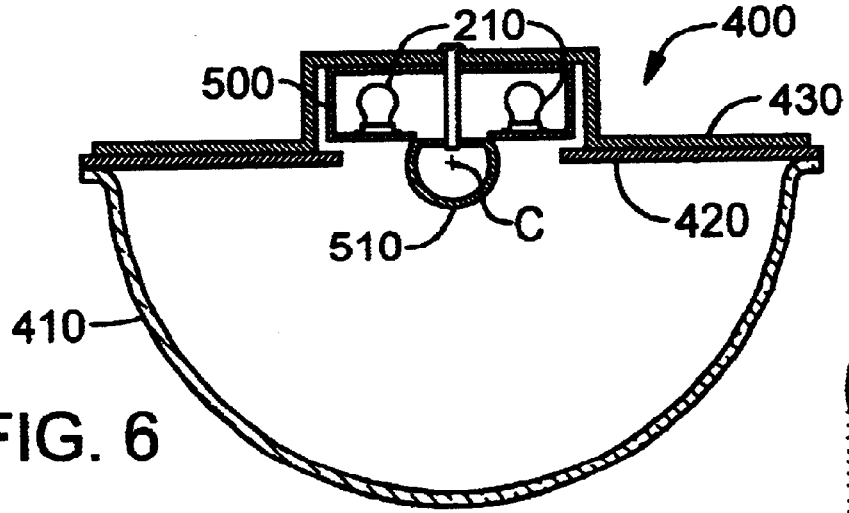
FIG. 6
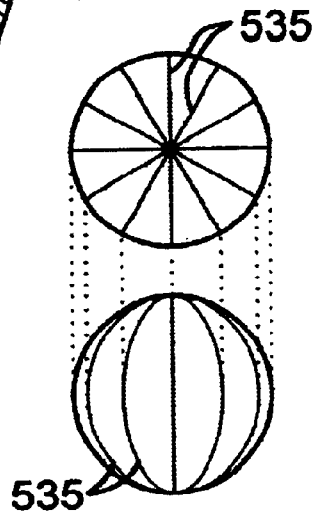
FIG. 7B
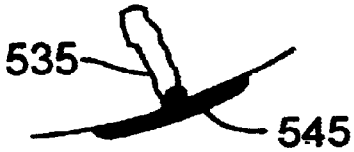
FIG. 7C
FIG. 7A
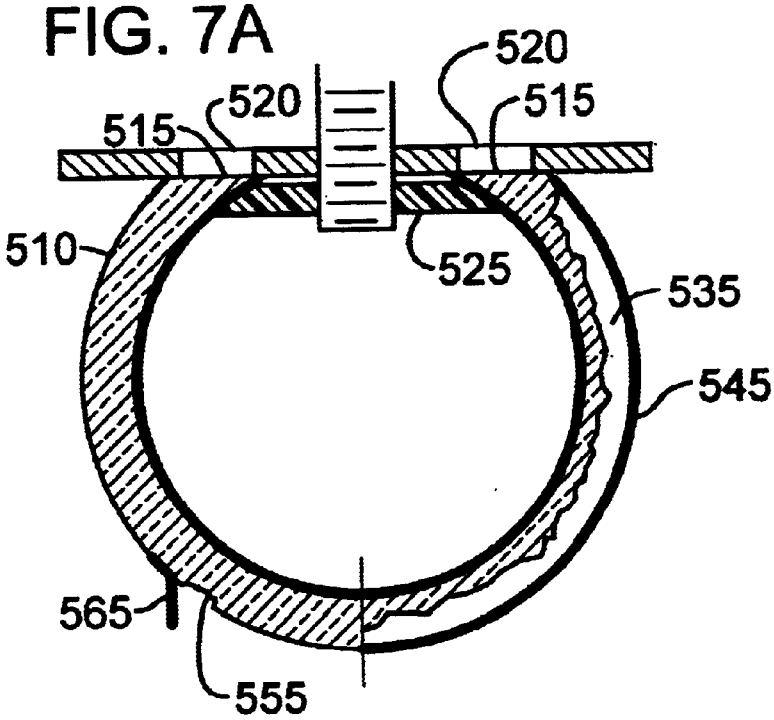
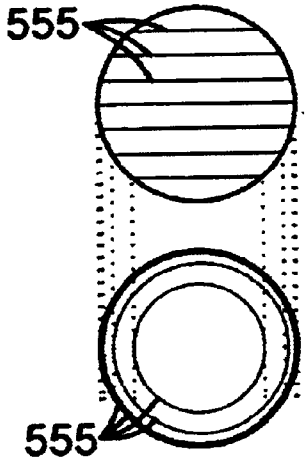
FIG. 7D

TRACKING MIRROR

This application is based on my U.S. Provisional Patent Application No. 06/146,040, TRACKING MIRROR, filed Jul. 28, 1999, from which I claim priority.

This Invention is based on my previous work expressed in U.S. Pat. No. 4,971,312, ILLUSION APPARATUS, U.S. Pat. No. 5,681,223, TRAINING VIDEO METHOD AND DISPLAY, and, particularly, U.S. Pat. No. 5,871,404, OPTICAL BLOB, the contents of each being here incorporated by reference thereto.

BACKGROUND

The Tracking Mirror is preferably used in place of typical security mirrors commonly used in retail stores to catch shoplifters. Security mirrors are convex, to allow wide angle coverage, and are generally mounted near or on the store's ceiling, to provide unobstructed aerial views. Commonly, store personnel monitor the premises by occasional glances at the mirrors. Security mirrors are often semi-transparent (i.e., with reflective coating thin enough to allow some light to pass through) to allow video cameras or security personnel to carry out hidden surveillance from behind the mirrors.

In most cases it is unlikely that security personnel are peering down through a mirror. It is also unlikely that a video camera will at any moment be properly positioned to catch a shoplifter in the act and, even if a camera sees the act, security personnel may not be monitoring that camera at that time. A potential shoplifter will, however, check reflections in the security mirrors to see if personnel in the store are watching him/her.

GENERAL DESCRIPTION

It is a purpose of this Invention to deter theft (and/or other crimes) by adding an additional factor of intimidation to dissuade potential shoplifters from becoming "kinetic" shoplifters. Under the preferred embodiment, when a potential shoplifter looks up to check a security mirror (to see if store personnel are watching), he/she sees a red circle about his/her own reflection in the mirror.

The Invention appears in a preferred embodiment for each of the two commonly known security mirror types.

DESCRIPTIONS OF THE FIGURES

FIG. 6 is a side section through the centerline of the hemispherical mirror (with a lamp housing) of the second preferred embodiment.

FIG. 7A is a section through the centerline of the transparent globe of the second preferred embodiment. The right side of the figure shows a typical meridian; the left side shows a typical parallel.

FIG. 7B shows the meridians of FIG. 7A projected to an elevation.

FIG. 7C is a detail section through a masked groove in the transparent globe of the second preferred embodiment.

FIG. 7D shows the parallels of FIG. 7A projected to an inverted plan view.

FIRST PREFERRED EMBODIMENT

Figure 1:
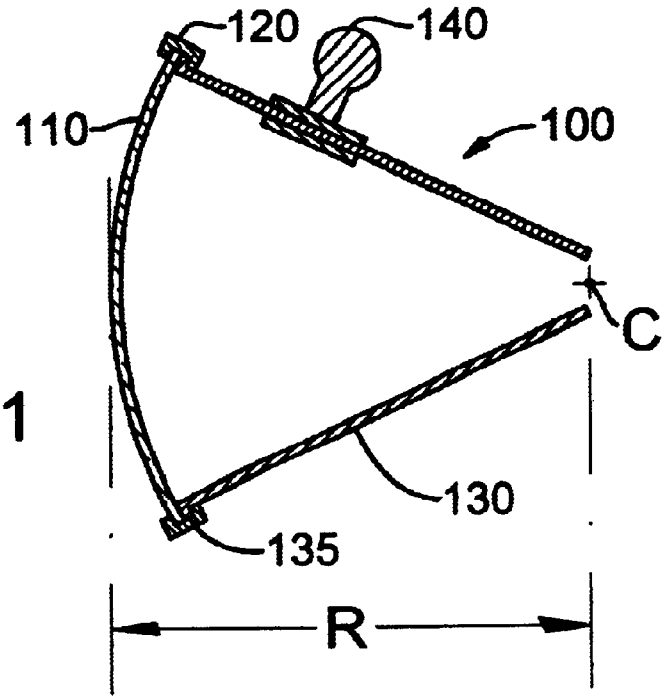
FIG. 1 is a side section through the centerline of the mirror and conical housing of the first preferred embodiment.
Figure 2A:
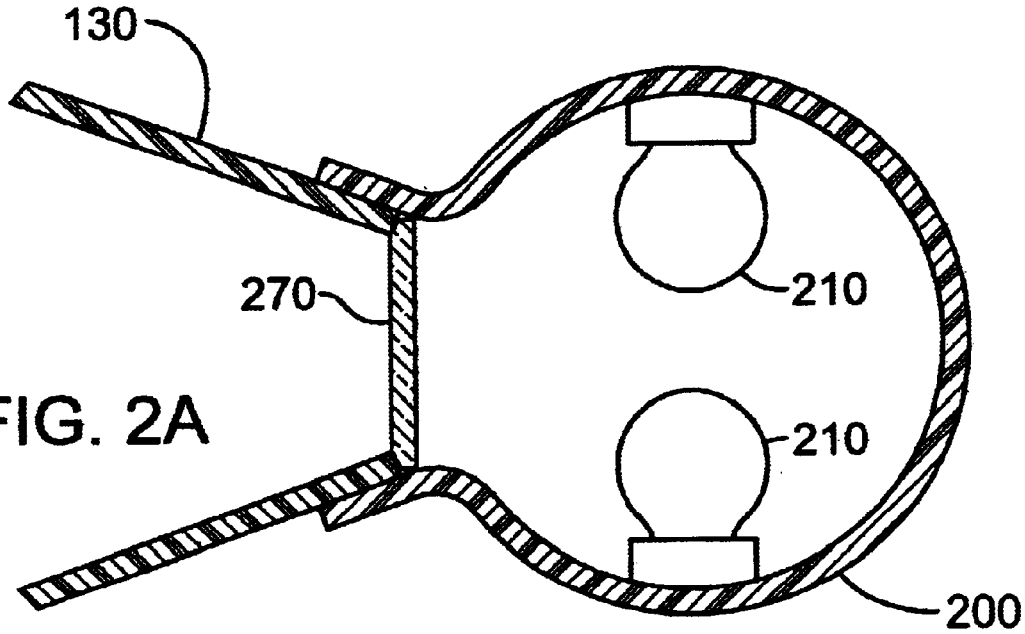
FIG. 2A is a side section through a lamp housing attached to the conical housing of FIG. 1
Figure 2B:
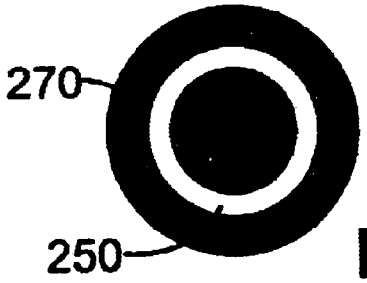
FIG. 2B is a front elevation showing the preferred red circle in a transparency.

The first preferred embodiment 100 incorporates a shallow (preferably about 30–60 degrees of a sphere) convex mirror 110.

A security mirror of this type is generally not partially transparent, as required in the Invention, but is an ordinary convex mirror mounted in a circular channel frame with backing of, typically, masonite. The masonite is mounted in turn to an arm with, typically, a ball and socket joint for adjustment. The arm terminates at a mounting bracket so that it may be attached to a wall or ceiling.

In the preferred embodiment for this type of security mirror, a typical mirror blank is coated with a reduced amount of silvering (typically aluminum), as is known in the art, to create partially transparent mirror 110. Roughly equal reflection and transmission are useful, but, where brightly lit spaces allow, lighter silvering is preferred. In any case, the Invention tolerates a rather wide range of silvering.

Typical circular channel frame 120 is used, without the masonite, to mount mirror 110 to a preferably conical housing 130. Conical housing 130, its large end being slightly smaller than the mirror 110, engages the frame with flange 135, flange 135 matching the diameter of mirror 110. Flange 135 may be discontinuous.

Conical housing 130 may be of any durable material such as blow molded plastic or galvanized sheet steel. The inside of conical housing 130 is preferably matte black; the outside is preferably a neutral color so as to minimize its apparent size.

Typical mounting arm assembly 140 is attached, not to the (no longer present) masonite backing, but to the wall of conical housing 130. Conical housing 130 provides for minimum restriction in mirror mounting position and orientation.

Conical housing 130 is preferably truncated at a plane coincident with center of curvature C of convex mirror 110. At that distance, the small end of conical housing 130 is preferably about a quarter the diameter of mirror 110.

To the small end of conical housing 130 is mounted, by ordinary means, lamp housing 200, containing lamp or lamps 210. Lamp 210 may be of any type. Transformers, batteries, ballasts, etc. (as needed) may be contained within or attached to lamp housing 200 or placed elsewhere. Lamp housing 200 may be vented.

A transparency 270 (or translucent image) of a circle 250 (preferably red with a black center and a black frame) is mounted in the front of lamp housing 200 (the side toward conical housing 130). Where a red transparency 270 is used, the inside of lamp housing 200 is preferably white. A clear transparency 270 can be used to display a red circle if the interior of lamp housing 200 is red or if lamps 210 are red.

Figure 3:
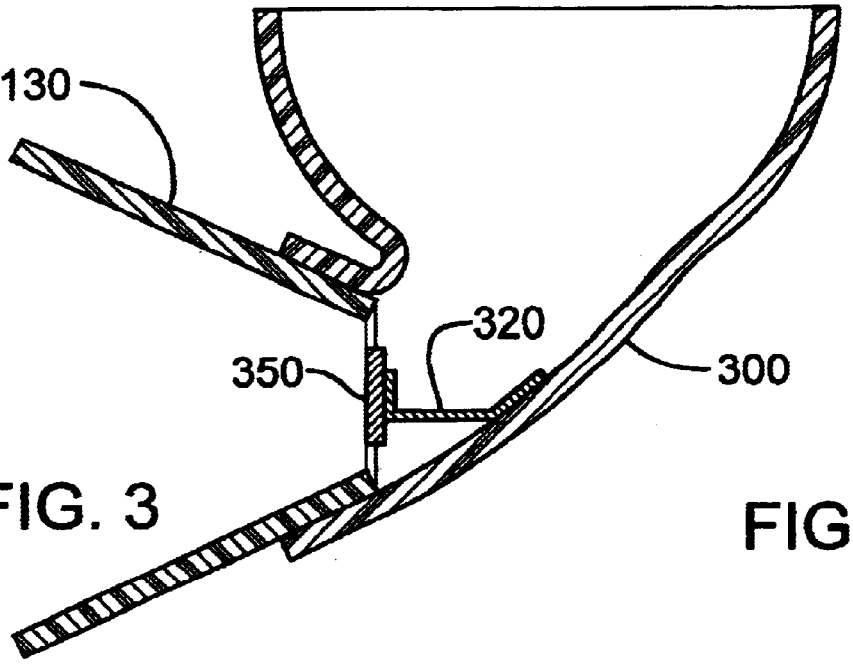
FIG. 3 is a side section through a light catcher attached to the conical housing of FIG. 1.
Figure 5:
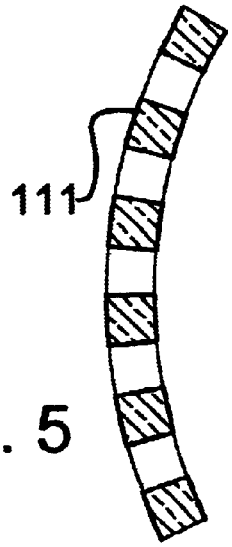
FIG. 5 is a side section through a perforated convex mirror.
Figure 4:
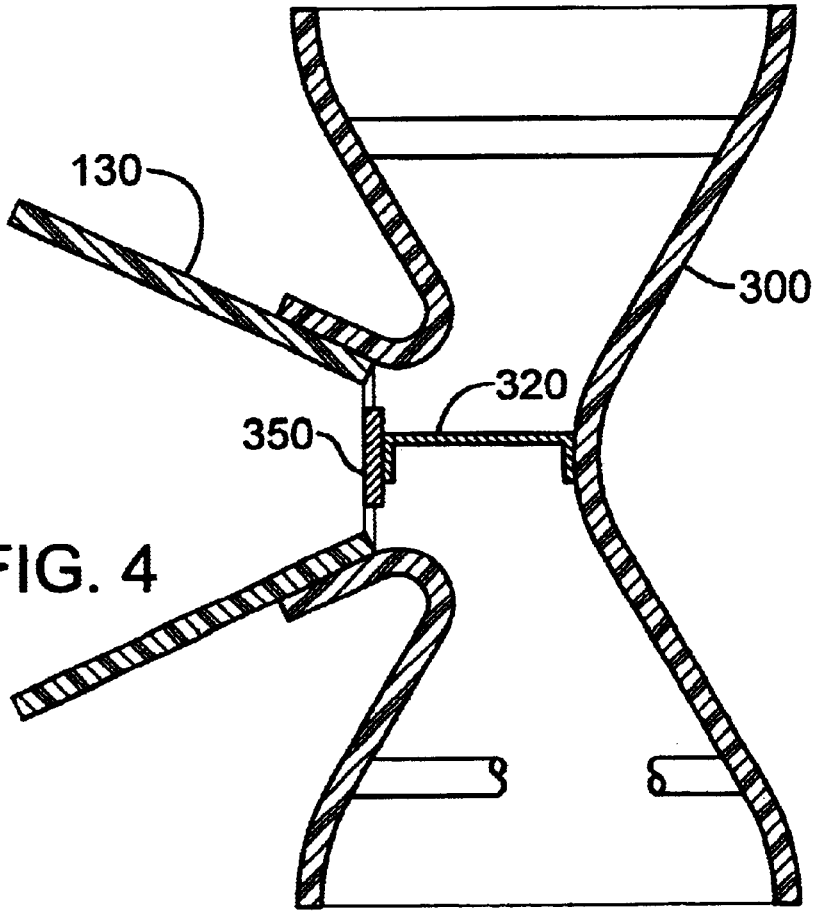
FIG. 4 is a side section through a wide-angle light catcher attached to the conical housing of FIG. 1.

Preferred for economy, particularly for use with this first preferred embodiment, and particularly for use in brightly lit stores (where mirror silvering can be particularly thin), is light catcher 300 in place of lamp housing 200. Basically a scoop (as shown in FIG. 3), white inside or mirrored, light catcher 300 can be positioned beneath a ceiling fixture or anywhere under a generally illuminated ceiling. Even though an upward opening scoop is preferred, light catcher 300 can be open, or transparent or translucent in other or all directions (as shown in FIG. 4).

It may be preferable, in a light catcher embodiment, to modify the color of the otherwise preferably red circle 250, perhaps even tolwhite, in order to take fuller advantage of the ambient light.

The lamp housing 200 or light catcher 300 may be adjustably mounted. Adjustments parallel to the mirror can be used to more precisely position red circle 250, preferably concentric with the center of curvature C of mirror 110.

Adjustment toward mirror 110 will cause red circle 250 to lag behind as the viewer's image moves away from the center of mirror 110. Adjustment away from mirror 110 will cause red circle 250 to lead the viewer's image as the image moves away from the center of mirror 110. Such adjustment may be used intentionally for beneficial effects in some embodiments of the Invention or in other embodiments of the Patents incorporated herein.

In a preferred embodiment, lamp housing 200 or light catcher 300 is preferably red inside and has a circular aperture (preferably about one sixth the mirror diameter) facing the mirror. Preferably metal disk 350 is supported on bracket 320, hidden behind (i.e. on the lighted side of) itself. Disk 350 is preferably black on the side facing mirror 110 and red on the back side. Bracket 320 is preferably red.

Disk 350 is smaller in diameter than housing 130 at that point so that a bright red ring around it is visible through mirror 110. Metal disk 350 will be more durable and heat tolerant than the alternative transparency.

Also for durability, and for harsh or hazardous locations, the mirror itself may be formed from polished metal such as stainless steel, well known in some security mirror products. It is however required that the mirror be partially transparent. The mirror 111 is, therefore, formed from perforated stock or may be perforated as part of the forming process (by punching) or after forming (as by drilling).

Such a mirror 111 can be painted (or otherwise finished) matte black on its concave side to suppress unwanted reflections. This is a valuable structure for many uses of the diverse embodiments of the present Invention and of the other Patents incorporated herein by reference. Not only are miscellaneous reflections suppressed, but the ability of the concave side to focus collimated light is obviated. Mirrors of diverse materials can be manufactured by ordinary means to take advantage of these benefits of perforated mirrors.

SECOND PREFERRED EMBODIMENT

The second preferred embodiment 400 incorporates a hemispherical (or essentially hemispherical) mirror 410.

A security mirror of this type is generally dropped through a hung ceiling and may be partially transparent, particularly for video surveillance through the mirror.

This type of mirror does not require the conical housing of the first preferred embodiment. Because the center of curvature C is roughly equivalent to the back edge of the mirror 410, a simple flat cover 420 is preferred. Cover 420 has a central aperture, but generally prevents stray light (from above the ceiling) from entering the mirror.

At the center of cover 420 is mounted lamp housing 500, similar to that in the first preferred embodiment. Horizontal hanger bar 430 is preferably provided to straddle the back edge of mirror 410 (above flat cover 420) so that flat cover 420 need not support lamp housing 500.

If the viewer moves far off the mirror's axis, two problems can appear. First, red circle 250 begins to appear more and more elliptical. Second, commercial mirror domes tend to have less accurate curvature away from the axis.

Fortunately, however, people walk on the floor and security mirrors are mounted at the ceiling. For that reason, the periphery of hemispherical mirror 410 is not used and an additional concentric area is active only for very distant viewers. Furthermore, hemispherical mirrors substantially reduce the size of images of the distant viewers.

For example, a six foot tall viewer, fifty feet from an eighteen inch radius dome mounted to a twelve foot ceiling, will see his/her image about 83 degrees off the axis of the mirror. However the image will be only about an inch tall, fairly indistinguishable at that distance. Moving in to twenty-five feet, the same viewer will see his/her two inch tall image about 77 degrees off the mirror axis. At twelve feet, the image will be about four and a quarter inches tall at about 63 degrees off the mirror axis. Figures for the same conditions with a twelve inch radius mirror are three quarters of an inch at 83 degrees, an inch and three eighths at 77 degrees and two and three quarter inches at 63 degrees.

These numbers are good enough to avoid problems due to mirror curvature, but red circle 250 may come to appear undesirably elliptical which would tend to reveal that red circle 250 is not actively tracking the viewer.

Therefore, lamp housing 200 of the first preferred embodiment 100 must be modified to protect the illusion. Lamp housing 500 of the second preferred embodiment 400 preferably has, protruding from it, hollow transparent globe 510. The purpose and structure of hollow transparent globe 510 are described below.

Red Circles

It is important to recognize that a red circle is preferred, not mandatory. A circle is preferred for security mirrors to very definitely define the viewer's position while leaving a clear image of the viewer. Red is preferred as I believe it to be more intimidating for this purpose than other colors. Red is, however, more subtle than, say, adding crosshairs to the circle.

Additionally, the circle carries no meaningful size or other information to help the viewer distinguish the actual position of the circle in space. And the circle, although actually behind the viewer's image, interferes as if it were in front. That, and the compelling connection between a picture (the viewer's image) and its frame, all lend to the impression that the red circle is actively tracking the viewer.

Some of what follows is more useful or preferable in either the first preferred embodiment 100 or second preferred embodiment 400 or in other embodiments of the Invention or in other embodiments of the Patents incorporated herein.

The problem of the red circle appearing elliptical, with mirrors of the second preferred embodiment 400, can be solved in different ways according to the requirements of the moment.

For the reasons stated above, a red circle is still the preferred image for both preferred security mirror embodiments. Furthermore, a red circle is easy to use in the first preferred embodiment 100 and it may be preferable to maintain the same image across a line of products incorporating both preferred embodiments.

A bright spherical object, at the center of curvature of the mirror, will appear through the mirror as a disk, regardless of the point of view. But a disk of light is not a circle and, although effective in tracking, will wash out the image of the viewer. To form the image of a circle, the center of the disk must be obscured. That would be easy if only one point of view was being addressed. But the disk is actually a sphere and the center must be obscured from any point of view, with the periphery, preferably always, remaining bright.

Preferably, hollow transparent globe 510 is positioned about the center of curvature C of mirror 410. Globe 510, which may be clear or tinted (preferably red), has an aperture at the top that is preferably formed by (or as if) cutting the globe horizontally. The top edge of globe 510 will, therefore, be flat. Flat edge 515 is then conveniently illuminated, preferably through a ring shaped aperture, from lamp housing 500 or a light catcher 300.

Alternatively globe 510 may be formed with neck 530 at the top, neck 530 terminating in a flat, circular surface 515. If neck 530 is incorporated it must be integral with globe 510 and the transition between the cylindrical shape of neck 530 and the spherical shape of globe 510 must be well faired (to avoid light leakage).

Since globe 510 is transparent, light is held within the globe wall by internal reflection and very little light is emitted from its inner or outer surface, except at flat top edge 515. To obscure top edge 515 from view from below, black disk 525 can be positioned inside the top edge of globe 510. It is preferred, however, to obscure the entire inner surface of globe 510, which may be accomplished by, e.g., filling globe 510 with a black foam ball or painting the inside black.

To make globe 510 appear, from any point of view, as a bright circle, globe 510 is scored or grooved or drilled or etched (by ordinary means). The scoring, grooving, drilling, or etching pattern may be a multiplicity of (preferably equally spaced) meridians 535. Internal reflection in the globe wall will thereby be disturbed and, as is well known in the art, meridians 535 will emit light. As dictated by well-known principles of geometry (and as shown in FIG. 7B), meridians 535 will appear, when viewed generally horizontally, close together at the perceived edges of globe 510 and farther apart near the center.

It is preferred that each meridian 535 be obscured by a black mask 545 or painted over on the outside surface of the globe. Black mask 545 is broader than the underlying meridian 535 to obscure meridian 535 from a reasonably wide angle (about 60 degrees). Thus meridians 535 near the center of any generally horizontal view of the globe will be invisible through mirror 410. Those at the edge of any horizontal view of globe 510 will not only appear, but will appear close together as a bright ring.

It is sometimes (as when space under mirror 410 is not accessible or when another mirror 410 "watches" the space) not necessary to accommodate views from the underside of mirror 410. However, if desired, parallels 555 can also be added to the pattern to extend the illusion to all points of view. If parallels 555 are added, it is preferred to mask each parallel 555 with a ring 565. Each ring 565 is preferably cylindrical, rather than conical, to obscure generally horizontal views of the associated parallel 555 while leaving parallel 555 visible to a viewer below. The series of parallels 555 is preferably terminated shortly north of the equator of the globe 510, where the parallels 555 are no longer visible, through the wall of globe 510, from below.

Meridians 535 and parallels 555 described above are preferred for some uses. A pattern that accomplishes a similar result with more consistent coverage from many angles is more generally preferred. The more generally preferred pattern can also be formed by scoring, grooving, drilling, or etching.

The more generally preferred pattern, actually a very large class of patterns, is a somewhat uniform, relatively fine (to appear, from a distance, to be essentially continuous) pattern, which may be a grid or dot pattern or a random stipple. The elements of the pattern preferably cover about fifty percent of the surface area of globe 510. The pattern is then masked so it cannot be seen directly on the outside of globe 510, but only through the opposite surface of globe 510. The center of globe 510 being opaque, the generally illuminated surface of globe 510 thus appears as a bright circle.

Although not quite as bright (with similar illumination) as the scored, grooved, or etched globe, it is often preferred, particularly for economy, to use a smooth surfaced (i.e. not scored, grooved, drilled, or etched) transparent globe 510 and to apply paint or ink 560 of a light shade to take the place of the scoring, grooving, drilling, or etching. Where paint or ink 560 is applied, it will disturb the internal reflection in the transparent globe 510 and light will escape from the globe's surface.

A particular advantage of this approach is that the illuminated pattern, being essentially two-dimensional, can be masked by an essentially congruent dark pattern, rather than a dark pattern with larger elements (necessary to cover disparate viewing angles in more three-dimensional patterns).

Paint or ink 560 can be applied by any ordinary means such as manual brush painting, spraying, or silkscreen. White or red paint or ink 560 is preferred for the reasons discussed above. The pattern may be regular or irregular, but (although not absolutely necessary, because the outside surface of the pattern is not directly illuminated) should be covered with a congruent pattern of preferably matte black paint or ink 565. The congruent pattern of dark paint or ink 565 can be created either by controlling the placement of the paint or ink, as in stenciling or silkscreen, or by allowing dark paint or ink 565 to adhere to the pattern of white or red paint or ink 560 and wiping it from the smoother surface of the preferably glass, transparent globe 510. The latter technique can also be used and is particularly effective with a shallow etched pattern. The etched pattern can be overpainted with white or other light colored paint 560 and then overpainted with a mask of black or other dark paint or ink 565.

A stippled pattern of sprayed paint (easy and economical to accomplish by reducing air pressure as is known in the art) can thus be used as the basic pattern (different for each individual globe). With such a stippled pattern, illuminated elements are seen through the "haze" of the dark pattern overlaying a different section of the stipple. This may be better appreciated by examining FIG. 13.

Figure 13:
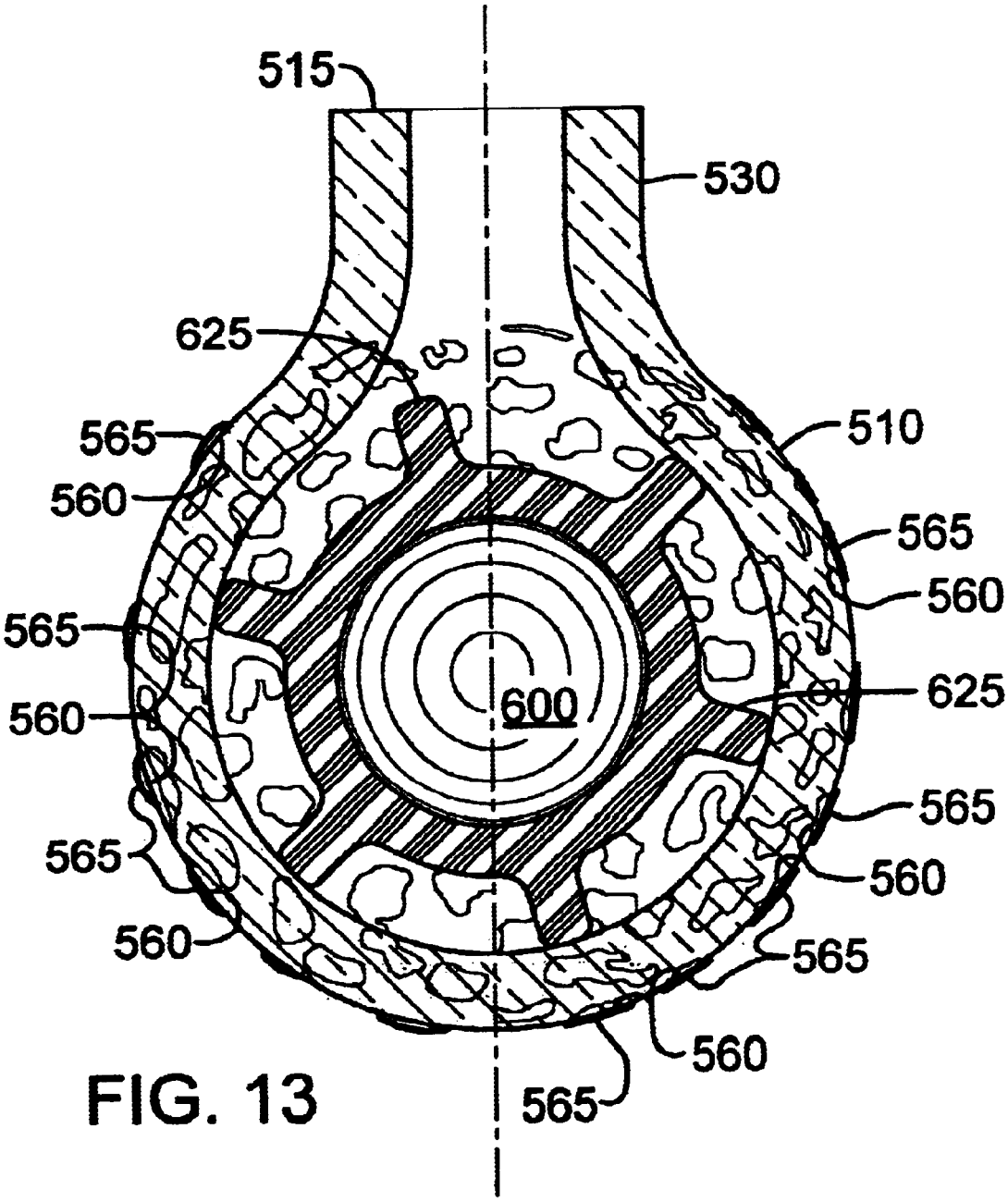
FIG. 13 is a side section through the centerline of an alternative transparent globe of the second preferred embodiment. The left side of the figure shows a surface pattern; the right side shows an etched pattern.

FIG. 13 also shows how the thickness of the illuminated circle can be made greater than the actual thickness of transparent globe 510. Rather than black painting the interior of globe 510 or filling the globe, dark (preferably matte black) sphere 600, somewhat smaller than the interior of globe 510 and preferably of resilient material, such as synthetic rubber (so that it can be easily installed), is suspended inside of and concentric with globe 510. This is most easily accomplished by providing dark sphere 600 with a plurality (or even a multiplicity) of protrusions 625 sufficient to contact the interior surface of globe 510, thereby supporting dark sphere 600.

Reflections between the concave face of mirror 410 and the polished surface of globe 510 can, if intrusive, be suppressed by ordinary means or by use of perforated mirror 111 disclosed above (here being extended to essentially a full hemisphere).

Tracking Without A Mirror

Although it is preferred to install the various embodiments of illuminated globe 510 into a hemispherical mirror 410, globe 510 (or one of the other illuminated objects discussed herein) is useful as a stand-alone tracking device. An observer, seeing that an illuminated circle is turning to follow him/her, will believe that the circle is an active tracking device.

Figures 8A, 8B:
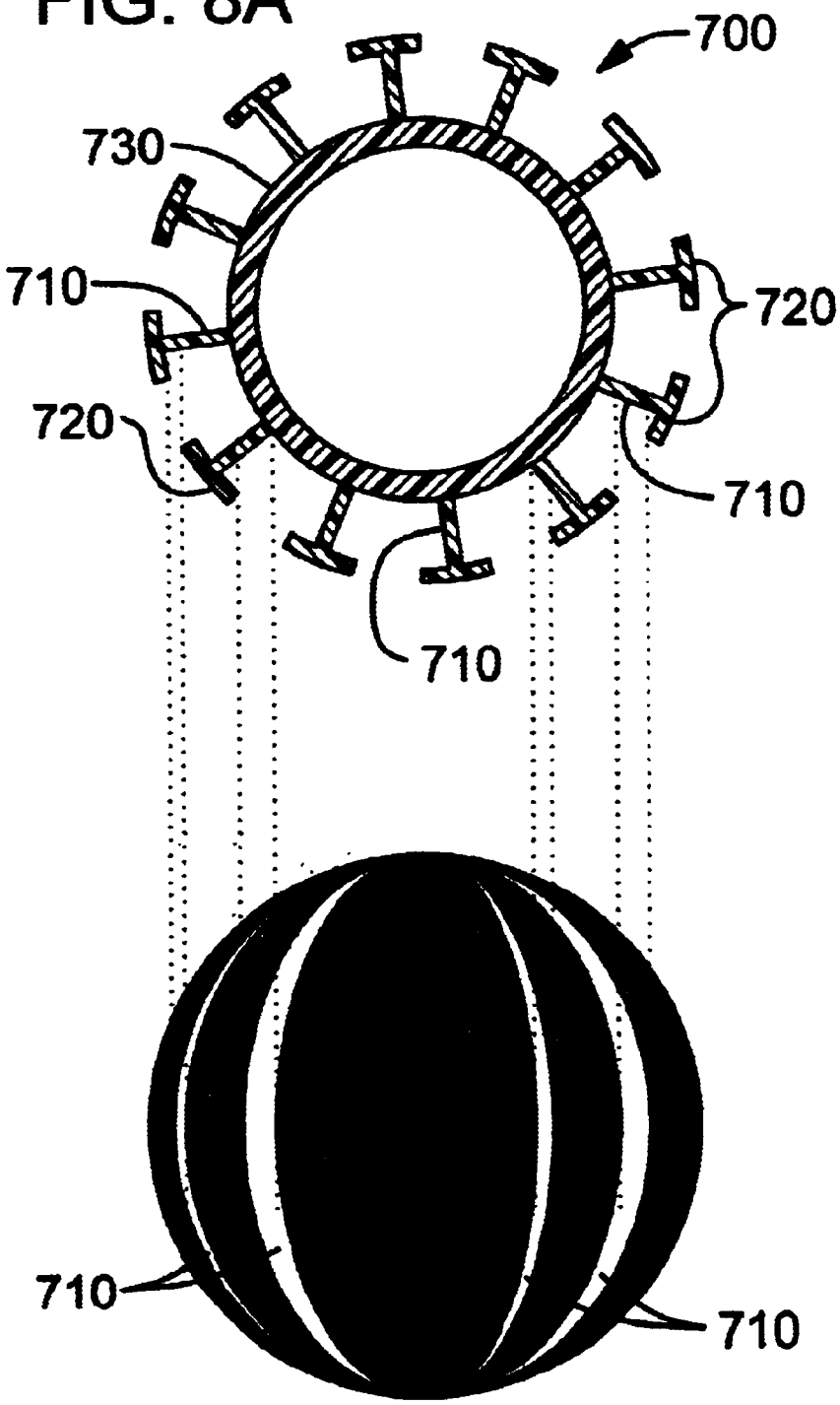
FIG. 8A is a plan section through the equator of an alternative globe for the second preferred embodiment.
FIG. 8B is an elevation of the visible pattern of the alternative globe of FIG. 8A.
Figure 9A:
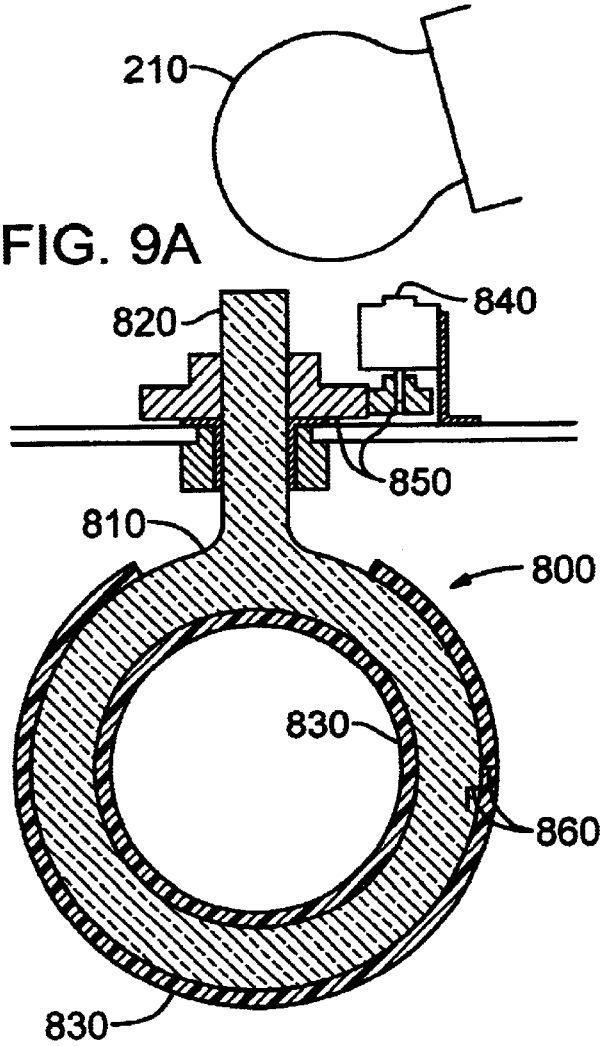
FIG. 9A is a side section through the spinning ring of an alternative to the second preferred embodiment.
Figure 9B:
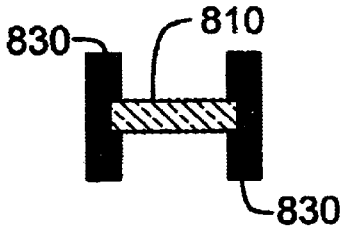
FIG. 9B is a plan section through one side of the ring of FIG. 9A.
Figure 9C:
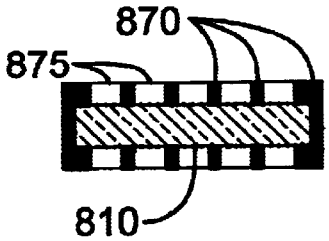
FIG. 9C is an alternative to the embodiment shown in FIG. 9B.
Figure 10:
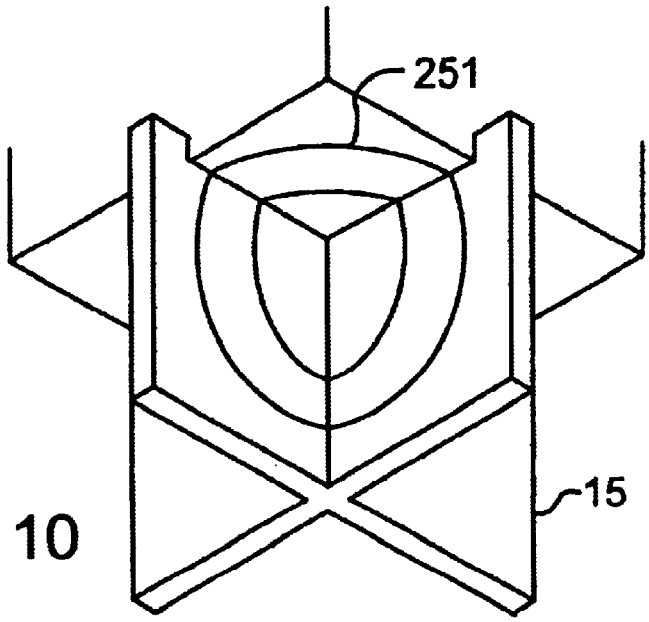
FIG. 10 is an isometric drawing of an alternative to the illuminated object of the second preferred embodiment.
Figure 11A:
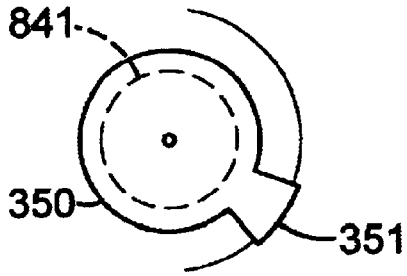
FIG. 11A is a front elevation of the turning disk used in an enhancement to the first preferred embodiment.
Figure 12:
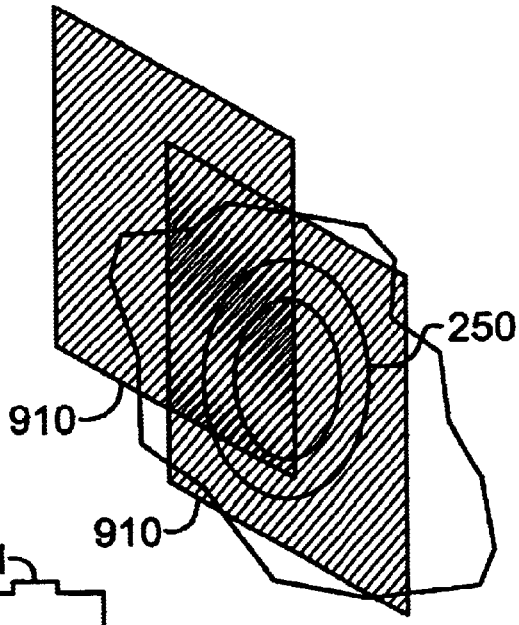
FIG. 12 shows a moiré version of the circle of the first preferred embodiment.
Figure 11B:
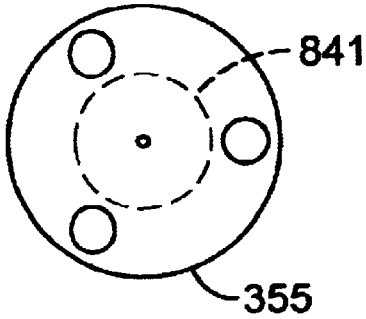
FIG. 11B is a front elevation of the spinning disk used in an enhancement to the first preferred embodiment or an alternative in the second preferred embodiment.
Figure 11C:
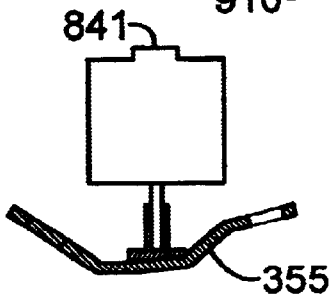
FIG. 11C is a side section of one embodiment of the disk of FIG. 11B.

In fact, particularly where a mirror is not present, useful tracking devices need not be internally illuminated. Some configurations (such as that shown in FIG. 8 and discussed below) can be brightly colored on those surfaces that would ordinarily emit light.

Alternate Illuminated Objects

A similar effect to that of globe 510 can be achieved by constructing a globe 700 of thin fins 710 as meridians. Fins 710 are oriented with their greater cross sectional dimension toward the center of globe 700. Each fin 710 preferably has a black mask 720 along the outer periphery and the center of globe 700 is preferably filled with black sphere 730. Black mask 720 is intended to obscure fin 710 from a reasonably wide angle.

Fins 710 are preferably translucent on their broad surfaces. Light can be introduced into their preferably polished upper ends essentially as for transparent globe 510 disclosed above. Or fins 710 can be solid, preferably brightly colored, and illuminated externally by ordinary means. In either case, the effect is similar to that of transparent globe 510, but without a polished surface to cause reflections. As discussed above, the latter embodiment is useful as a stand-alone tracking device.

A similar embodiment can be constructed by attaching a multiplicity of brightly colored, preferably cylindrical studs to a preferably spherical black core and applying a circular black mask to the protruding end of each stud. This will produce a more uniform circle.

Changing the shape of the core and/or the bright elements and/or the masks can produce a variety of useful embodiments. If, for example, the core is a vertical cylinder, bright elements such as described above will appear as two parallel bright vertical lines which will maintain their separation to a viewer moving around the apparatus. Bright rings around such a cylindrical array's top and bottom will result in the viewer seeing a rectangular tracking frame.

Alternatively, rotating light emitter 800 may be used to create the same effect. Ring 810 (or a vertically divided half ring), is rotatably suspended from above. Shaft 820, which supports internally transparent ring 810, is also transparent and integral with ring 810. The flat surfaces of ring 810 are etched to emit light and black masks 830 are applied to the curved inner and outer surfaces.

Preferably, the top end of transparent shaft 820 is illuminated from lamp 210 (in a lamp housing) or from a light catcher. Motor 840 drives transparent shaft 820 at preferably several hundred revolutions per minute by ordinary linkage, such as gearset 850. Spinning ring 810 will, therefore, be visible only when generally perpendicular to the direction from which it is viewed.

If viewing from below is expected, it is preferable to notch the outer surface of the ring, just below the equator. Right angle notches 860 with etched horizontal surfaces and black painted (or masked) vertical surfaces will appear as rings from below. Although, depending on masking, an angled view may introduce some ambiguity in the angle and position of the added ring, the overall effect will not be disturbed.

It may be preferred to provide a black shell 870 over ring 810. Black shell 870 is provided with a multiplicity of holes 875. The depth of each hole 875 in relation to its diameter will determine (by simple geometry) how much of the illuminated surface at the bottom of the hole can be seen from a particular viewing angle.

Masks or light baffles, to block certain lights from certain angles, are used effectively above. Light baffles, which might be large and attract attention if used in an open space, are particularly useful in embodiments of this Invention, and in embodiments of the Patents incorporated herein. In most embodiments of all of these inventions, dark objects behind the mirrors are invisible. In some cases it may be preferred to vignette the edges of baffles to soften the transition as a light appears from or disappears behind a baffle.

Baffles are used in a sometimes-preferred alternate to the globes disclosed above. Although this alternative may be illuminated in various ways, illumination from the top, from a lamp housing or light catcher by light conduction as disclosed above, is preferred.

An illuminated, flat red circle 251, as preferred in the first preferred embodiment, is positioned about the center of curvature C of hemispherical mirror 410. A cross-shaped aperture is preferably cut through the center of the face of lamp housing 201 with red circle 251. Mounted into the face of lamp housing 201 is a light transmissive (such as acrylic) structure 15 in the shape of two planar members crossing at 90 degrees at the center of the circle. If this structure is actually made of two planar members (such as acrylic sheet), the joint(s) should be masked in black. Each of the four segments of transmissive structure 15 has, etched into each face of its inner corner (the one in contact with the center of the red circle), a 90-degree segment of a circle. Red circle 251 and each of the circle segments are of equal radius, preferably about one tenth to one fifth of the mirror diameter. The planes of transmissive structure 15 are preferably red, to match red circle 251 (or can be illuminated with red light). The balance of the surfaces of transmissive structure 15 are painted opaque black. These protruding surfaces are baffles to interfere with the view of parts of the illuminated circle segments from various angles.

In use, the viewer sees a red image which is, for most points of view, not a circle. The red image may, from many points of view, be interrupted in spots by parts of the baffling planar members. Nonetheless, the image is fairly economical to produce and, although its shape is somewhat plastic, it will not close up like an ellipse and will look reasonably the same from any point of view.

In some embodiments, it may be preferable to use a circular neon lamp or a pattern of light emitting diodes (LED's) as the red circle.

Bells & Whistles

The effect of the tracking mirror can be enhanced by modifying or adding elements to Other two and three-dimensional shapes may be used as stand-ins for the red circle.

Fiber optics and light the preferred embodiment.

For example, in the first preferred embodiment 100, disk 350, which defines the center of red circle 250, can be mounted to a (preferably about 30 rpm) motor 841. Tab 351, added to the edge of disk 350, makes a gap in circle 250, which revolves to suggest a radarlike device.

With a larger revolving disk 355, having several apertures near the edge, the circle is replaced by a rotating ring of lights. Particularly if the disk is contoured, ambiguity of the light's actual position in space is enhanced, in some cases sufficiently for use in a hemispherical mirror 410.conductive rods, holograms and lenticular screens can be used to advantage.

A particularly effective enhancement is to add a pair of screens 910 in front of red circle 250 (preferably close to red circle 250, where they can be smaller). Screens 910, which may be perforation patterns or printed on transparencies, create a moire effect, causing much activity in red circle 250 as the viewer changes location.

The circle itself and/or the globe of the second preferred embodiment can also be patterned to form part of the moire assembly.

While the Invention has been described with reference to preferred embodiments thereof, it will be appreciated by those of ordinary skill in the art that modifications can be made to the Invention and to its uses without departing from the spirit and scope thereof.

I claim:

1. An apparatus which appears to actively track the position of a viewer of the apparatus comprising:

a three-dimensional, at least partially opaque core, defining the inside of the apparatus;

image elements, disposed about the outside of the core, whereby an image pattern is formed; and mask elements, forming a mask pattern, corresponding to the image pattern, positioned essentially concentric with and outside the image pattern, whereby image elements viewed head-on are, to the viewer, essentially hidden by their respective mask elements and image elements viewed at some angles other than head-on are essentially visible to the viewer, thereby inducing the illusion that the visible image pattern is turning to track the viewer.

2. The apparatus of claim 1, wherein the outside of the core is generally coincident with the inside of the image pattern.

3. The apparatus of claim 1, wherein the outside of the core and the inside of the image pattern are spaced apart, so that image elements are visible through the space.

4. The apparatus of claim 1, wherein the image pattern comprises a three-dimensional structure.

5. The apparatus of claim 4, wherein the three dimensional structure comprises discontinuities in a transparent body.

6. The apparatus of claim 1, wherein the image elements and mask elements are essentially two-dimensional.

7. The apparatus of claim 1, also comprising:

illumination means, disposed to illuminate the image elements.

8. The apparatus of claim 1, also comprising:

a partially transparent housing.

9. The apparatus of claim 8, wherein the partially transparent housing comprises a partially reflective spherical mirror.

10. The apparatus of claim 1, wherein the image elements and mask elements are successive positions of at least one typical image element and at least one typical mask element, disposed about the core by rapid displacement, the core being defined by the inside of the successive positions of the image elements.

11. The apparatus of claim 1, also comprising:

moiréscreens, positioned with the image pattern visible through them so as to induce an illusion of motion in the image pattern.

12. An apparatus which appears to actively track the position of a viewer of the apparatus comprising:

a spherical mirror; and an essentially circular image, with an open center, disposed essentially about the center of curvature of the spherical mirror.

13. The apparatus of claim 12, wherein the essentially circular image is red.

14. The apparatus of claim 12, also comprising:

illumination means, disposed to illuminate the essentially circular image.

15. The apparatus of claim 14, wherein the illumination means comprises a light catcher.

16. The apparatus of claim 14, wherein the illumination means comprises a light source.

17. The apparatus of claim 12, also comprising:

a rotating mask, disposed to selectively obscure portions of the essentially circular image; and rotation means, operatively connected to rotate the rotating mask.

18. The apparatus of claim 12, also comprising:

moiréscreens, between the essentially circular image and the spherical mirror, with the essentially circular image visible through them so as to induce an illusion of motion in the circular image.

19. The apparatus of claim 9, wherein the core, image elements, and mask elements are positioned about the center of curvature of the spherical mirror.

* * * * *